US007380683B1

(12) United States Patent
Oberhofer et al.

(10) Patent No.: US 7,380,683 B1
(45) **Date of Patent: *Jun. 3, 2008**

(54) CLOSURE FOR THE CHARGING HOLE OF A LIQUID CONTAINER

(76) Inventors: Kurt Oberhofer, 24 Höhenweg, Wilhelmsfeld D-69259 (DE); Karl Batschied, 1 Erlbrunnenweg, Wilhelmsfeld D-69259 (DE)

( * ) Notice: Subject to any disclaimer, the term of this patent is extended or adjusted under 35 U.S.C. 154(b) by 1418 days.

This patent is subject to a terminal disclaimer.

(21) Appl. No.: 10/470,659

(22) PCT Filed: Aug. 17, 2000

(86) PCT No.: PCT/DE00/02786

§ 371 (c)(1),
(2), (4) Date: Apr. 19, 2001

(87) PCT Pub. No.: WO01/14242

PCT Pub. Date: Mar. 1, 2001

(30) Foreign Application Priority Data

Aug. 20, 1999 (DE) ..... 299 14 457 U
Jul. 4, 2000 (DE) ..... 200 11 618 U

(51) Int. Cl.
*B65D 51/16* (2006.01)
*B65D 53/02* (2006.01)

(52) U.S. Cl. ..... 220/366.1; 220/203.07; 220/231; 220/360; 220/367.7

(58) Field of Classification Search ..... 220/366.1, 220/231, 253, 284, 360, 254.7, 254.8, 254.1, 220/367.1, 203.04–203.07
See application file for complete search history.

(56) References Cited

U.S. PATENT DOCUMENTS

| | | | | | |
|---|---|---|---|---|---|
| 1,747,873 | A | * | 2/1930 | Mastrone | 217/101 |
| 2,865,530 | A | * | 12/1958 | Gould | 137/321 |
| 2,962,185 | A | * | 11/1960 | Starr et al. | 220/254.8 |
| 3,086,679 | A | * | 4/1963 | Bijoet | 220/661 |
| 4,225,052 | A | * | 9/1980 | Tector et al. | 220/506 |
| 4,441,622 | A | * | 4/1984 | von Holdt | 217/99 |
| 4,552,283 | A | * | 11/1985 | Poldner | 220/304 |
| 4,595,172 | A | * | 6/1986 | Henderson | 251/321 |
| 4,627,550 | A | * | 12/1986 | Dines | 220/270 |
| 5,249,696 | A | * | 10/1993 | Bryant et al. | 220/367.1 |
| 6,065,631 | A | * | 5/2000 | Oberhofer et al. | 220/367.1 |
| 6,161,716 | A | * | 12/2000 | Oberhofer et al. | 220/203.04 |

FOREIGN PATENT DOCUMENTS

| | | |
|---|---|---|
| DE | 42 19 571 A1 | 6/1992 |
| DE | 100 00 335 A1 | 1/1999 |
| DE | 299 19 628 U1 | 11/1999 |
| WO | WO 99/23009 | 5/1999 |

* cited by examiner

*Primary Examiner*—Anthony D. Stashick
*Assistant Examiner*—Niki M. Eloshway
(74) *Attorney, Agent, or Firm*—Galgano & Associates, PLLC

(57) ABSTRACT

The closure has a bung bushing (10) of elastic material which fits sealingly into the charging hole of the container. The bung bushing (10) has a central opening. A bung plug (18) is seated sealingly in the central opening. The bung plug (18) can be pushed out in the direction of the inside of the container. It is the valve member of a manually operable pressure-compensating valve.

12 Claims, 7 Drawing Sheets

A-A

A-A

B-B

CLOSURE FOR THE CHARGING HOLE OF A LIQUID CONTAINER

The invention relates to a closure for the charging hole of a liquid container, with a bung or plug bushing of elastic material which fits sealingly into the charging hole and which has a central opening, and with a stopper or bung plug seated sealingly in the central opening.

Such closures are known from practice. They are used for tightly closing the charging hole of a liquid container. Examples of such containers are barrels, small barrels (party kegs) or cans, in which liquids, especially beverages, are filled without pressure or under pressure. In particular, they are used in party kegs for beer.

The bung-bushing and the bung plug seated therein comprise a preassembled unit which is driven into the charging hole at the end of the filling process. To draw off liquid, the container is tapped with a dispensing fitting. In the process, the plug is pushed out from the bung-bushing toward the inside of the container by means of a plunger tube. The bung-bushing seals against the plunger tube.

From practice there are also known liquid containers of the type mentioned in the introduction which have a lower discharge opening separate from the charging hole. This can be a bunghole, which is tapped with a dispensing fitting or the like, or it can be a dispensing tap integrated into the container.

For such containers it is known from International Patent WO 99/23008 A1 that the bung-bushing closure in the charging hole of the container can be provided with a pressure-compensating valve. For this purpose a valve element instead of a bung plug is seated in the bung-bushing. The valve element is designed to be operated by turning by hand. It occupies either a sealing closed position or a pressure-compensating position as desired in the bung-bushing. In the pressure-compensating position, the interior of the container is in communication with the atmosphere.

Because of vibrations during transportation and/or because of warming, considerable excess pressure can build up in beer kegs, with the result that practically only foam is dispensed at first. It is recommended that this excess pressure be carefully released via the pressure-compensating valve before dispensing for the first time.

If liquid is drawn without pressure from the lower discharge opening, a partial vacuum develops above the liquid level in the container. The container can be vented by means of the pressure-compensating valve, in order to dissipate this partial vacuum.

Tapping of the container at the bung-bushing closure containing the pressure-compensating valve is not provided in the prior art. At first, no need for this was seen, since a lower discharge opening is present on the container.

Now, however, the need also exists to tap such containers in conventional manner at the bung-bushing closure of the charging hole. This is true in particular when a dispensing fitting operated with $CO_2$ is to be used.

The object of the invention is to provide, for the charging hole of a liquid container, a bung-bushing closure which is equipped with a pressure-compensating valve and which can be tapped.

This object is achieved with a bung-bushing closure of the type mentioned in the introduction, by the fact that the bung plug can be pushed out toward the inside of the container and said bung plug serves as the valve element in a manually operable pressure-compensating valve.

In a preferred embodiment, the bung plug can be moved by turning in order to operate the valve.

In a preferred embodiment, the bung bushing has a lateral pressure-compensating duct, whose outer mouth is disposed above the liquid level in the completely filled container. Thereby it is possible to achieve pressure compensation when the container is completely filled. The bung plug has a sealing closed position in which it shuts off the inner mouth of the pressure-compensating duct, and a pressure-compensating position in which it opens a flow path from the inner mouth of the pressure-compensating duct to the outside of the bung bushing.

In a preferred embodiment, the bung plug has an outwardly protruding sealing bead, which in sealing position is disposed upstream from the inner mouth of the pressure-compensating duct.

In a preferred embodiment, the bung plug has a surface groove, which in the pressure-compensating position maintains the inner mouth of the pressure compensating duct in communication with the outside of the bung bushing.

In a preferred embodiment, the surface groove of the bung plug is externally covered and tightly closed in the sealing position. Thereby it is ensured that no residual liquid or rinsing liquid can enter the closure during filling. The closure therefore meets the most stringent hygiene requirements.

In a two-piece alternative embodiment of particularly simple construction, the bung plug has a slit for engagement of a turning tool, such as a screwdriver, a coin or the like.

In a three-piece alternative embodiment with greater operating convenience, an operating element with a handle for tilting upward and turning is embedded in the bung plug. In this way there is no need for a special turning tool.

In a preferred embodiment, the operating element is seated interlockingly with non-round shape in the bung plug. Thereby, when the handle is turned to operate the valve, the bung plug precisely accompanies this movement.

In a preferred embodiment, the operating element occupies a snap-in position in the bung plug. It can be removed from the bung plug by overcoming the catch on the handle.

In a preferred embodiment, the closure has an originality safeguard, which reveals whether or not the pressure-compensating valve has already been operated. Several versions are available for this originality safeguard:

In one version the handle can be fastened to the operating element with ribs, which break off and form readily visible fracture surfaces when tilted upward for the first time. This version is structurally simple. It does not reveal, however, whether the bung plug was turned with the operating element in the bung bushing without the handle having been tilted upward beforehand.

To secure the bung-bushing closure against such manipulations as well, a lead seal is interposed between handle and bung bushing, which seal tears away when the handle is turned relative to the bung bushing, when the handle is tilted upward for the first time, and even when these two movements are superposed.

In a first sub-version, the handle is equipped with a lead seal that snaps into the bung bushing and tears away from the handle when it is moved for the first time.

Achievement of this version encounters the difficulty that the material of the bung bushing is usually softer than that of the handle. It therefore cannot be ruled out that the lead seal will merely be released from the catch instead of tearing away from the handle.

To improve this functionally, an anchoring ring of hard material, on which a lead seal projecting out of the bung bushing is suspended, is embedded in the bung bushing in a further sub-version. The handle snaps onto the lead seal.

When the handle is moved for the first time, the lead seal is torn away from the anchoring ring.

The bung-bushing closure with the anchoring ring is a four-piece component. The anchoring ring can be injection-molded together with and around the bung bushing in the 2-plastic technique.

The anchoring ring can also be used to reinforce the bung bushing, so that it cannot be dislodged from the charging hole of the container without being destroyed.

The invention will be explained in more detail hereinafter on the basis of four practical examples illustrated in the drawings, wherein.

Figure 2:
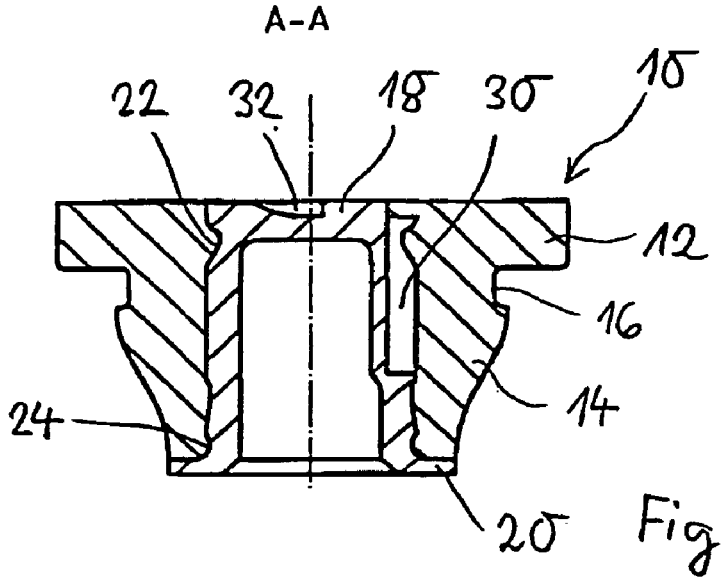
FIG. 2 shows a section through the closure along A-A of FIG. 1.
Figure 1:
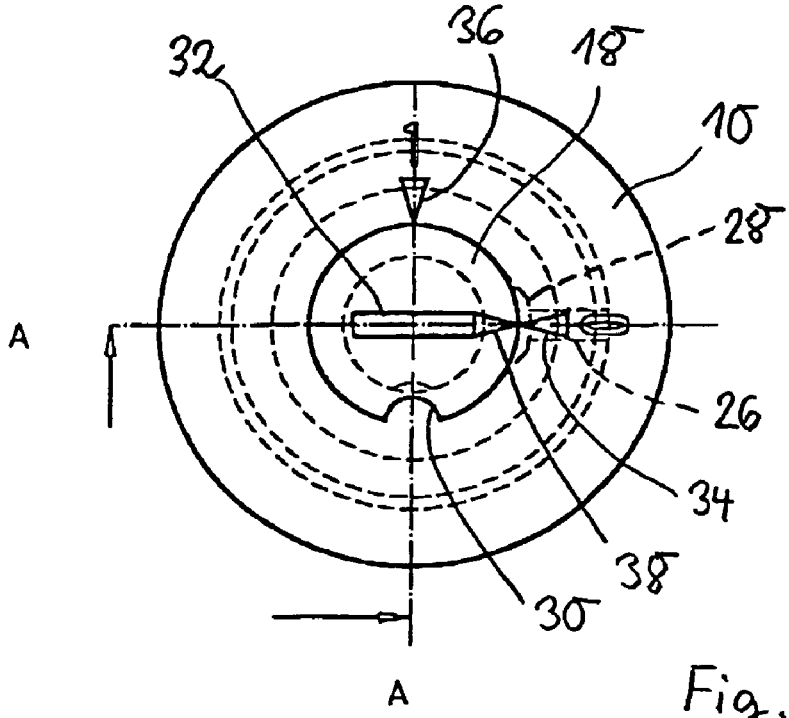
FIG. 1 shows a view from above of a two-piece bung-bushing closure with a section line A-A.
Figure 4:
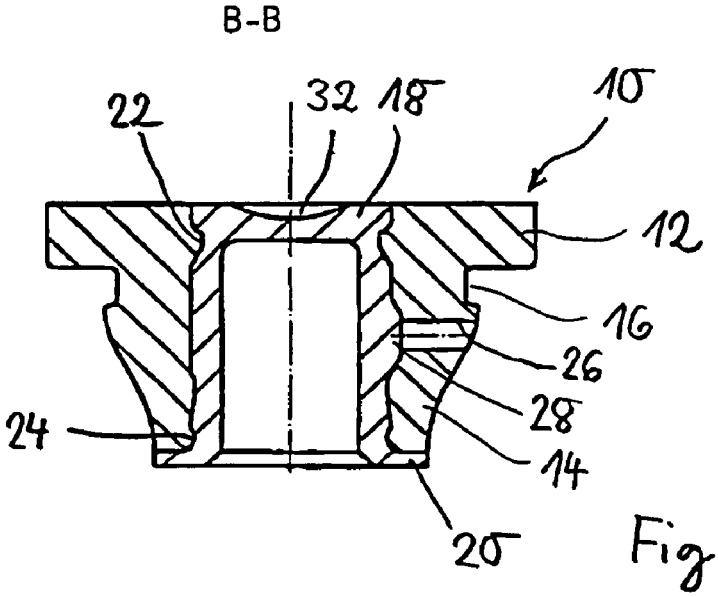
FIG. 4 shows a section through the closure along B-B of FIG. 3.
Figure 3:
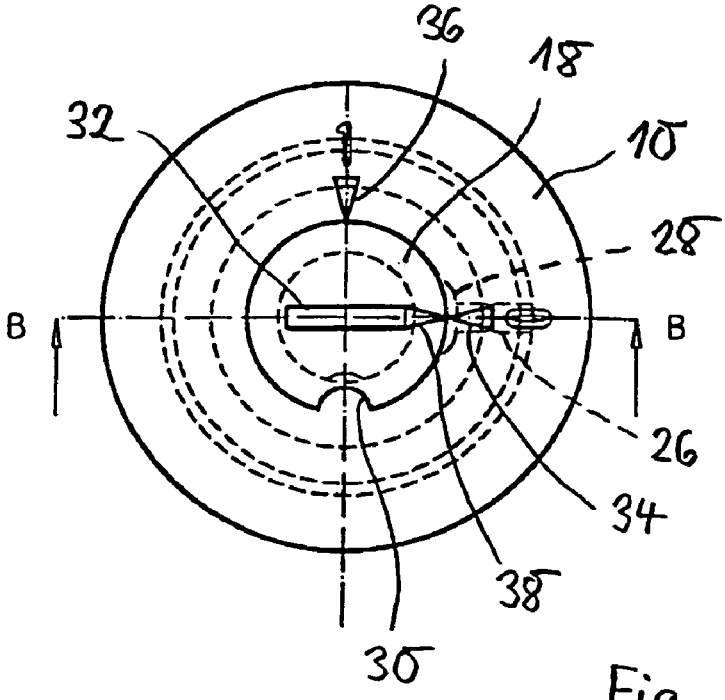
FIG. 3 shows the same view from above of the two-piece bung-bushing closure with a section line B-B.
Figure 6:
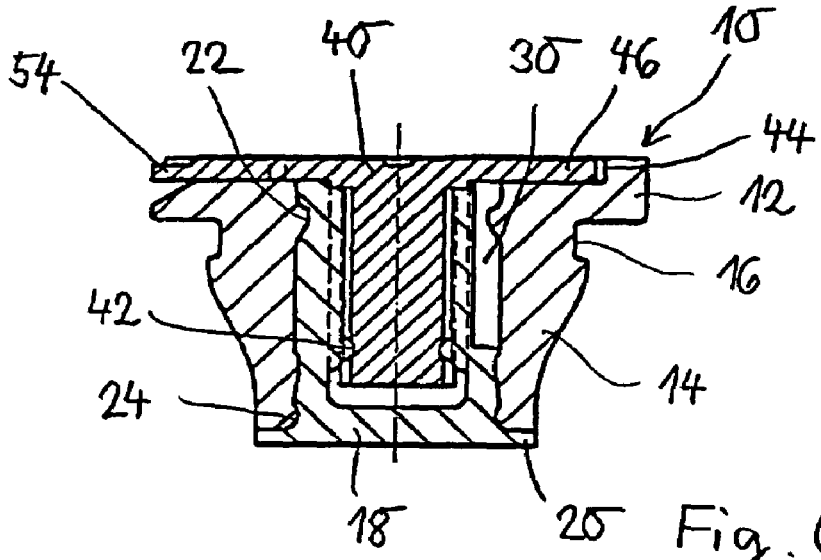
FIG. 6 shows a section through the closure along A-A of FIG. 5.
Figure 5:
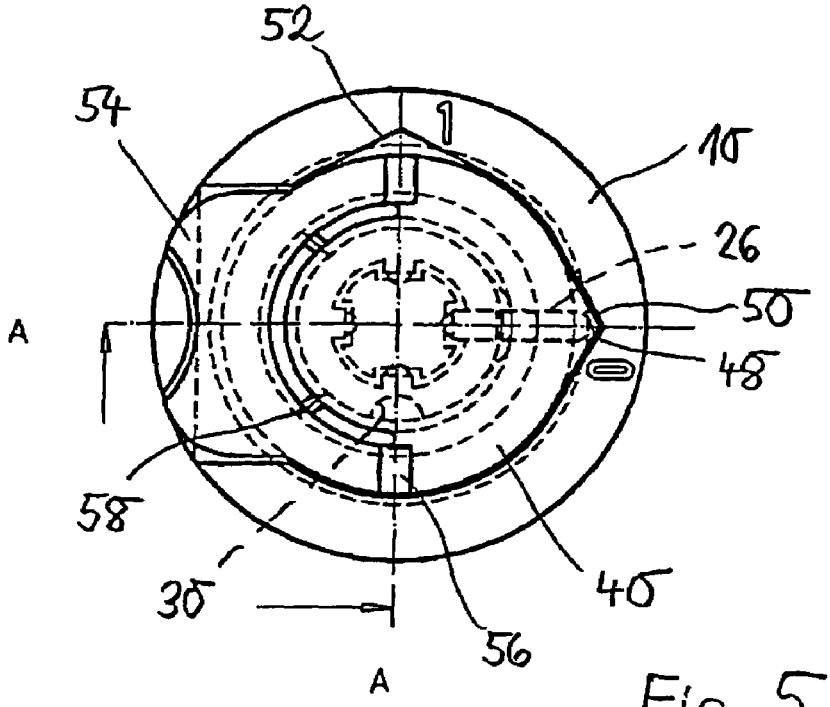
FIG. 5 shows a view from above of a three-piece bung-bushing closure with a section line A-A.
Figure 8:
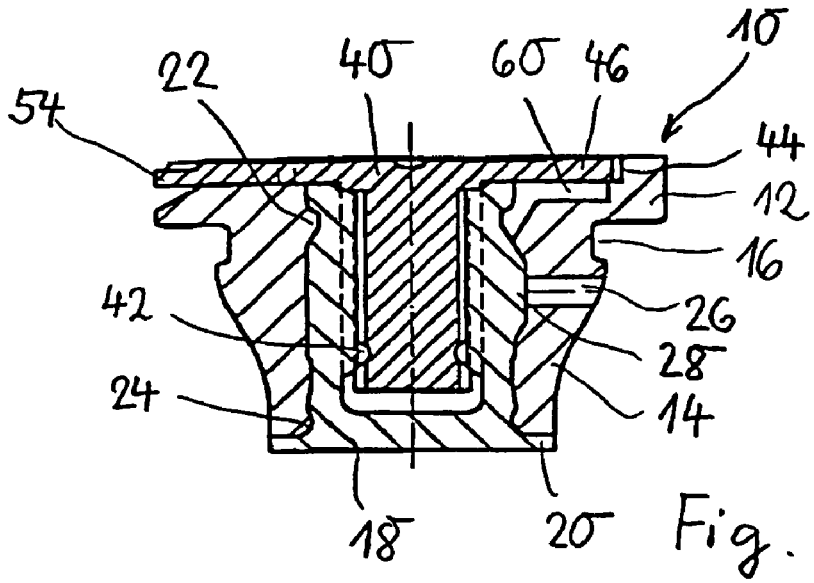
FIG. 8 shows a section through the closure along B-B of FIG. 7.
Figure 7:
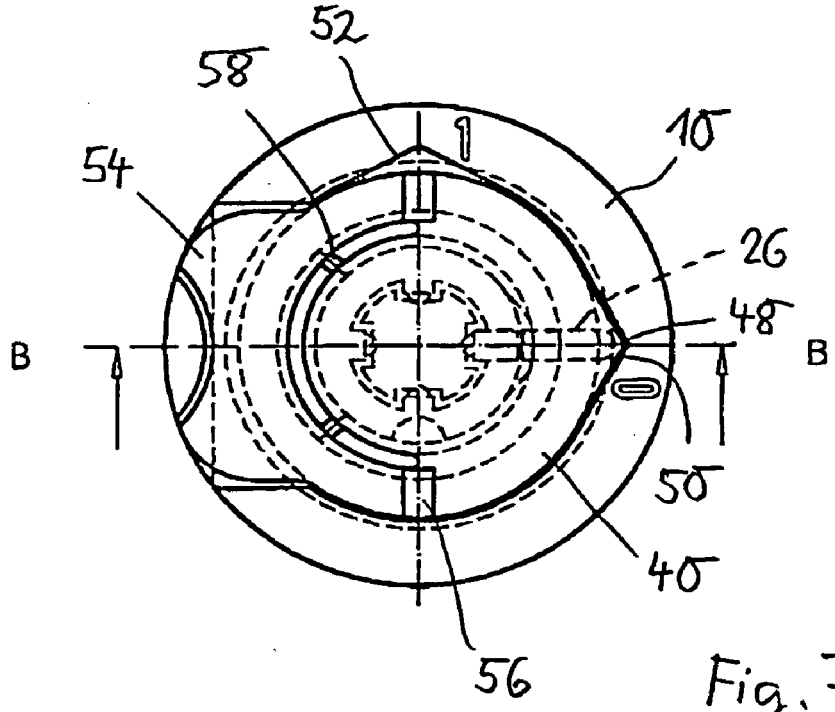
FIG. 7 shows this same view from above of the three-piece bung-bushing closure with a section line B-B.

The closure is provided with a bung bushing 10 of elastic material, which is substantially rotationally symmetric relative to its central axis and has an outwardly protruding flange 12, with which it bears against the outside wall of the container. Bung bushing 10 projects with a substantially conical tapering part 14 into the container. The surface profile of tapering part 14 has S-shaped curvature. Between flange 12 and tapering part 14 the diameter of bung bushing 10 is constricted to form an annular groove 16, into which the rim of the container opening fits sealingly when bung bushing 10 is driven in.

Bung bushing 10 has a central opening in which a bung plug 18 is seated. Bung plug 18 has a substantially cylindrical hollow body, which occupies the central opening. At its inner end there is a flange 20, which rests against the inner end of bung bushing 10.

On the inner surface of the bung-bushing central opening there are molded sealing beads 22, 24, which engage with complementary circumferential grooves of bung plug 18. Bung plug 18 thereby has a snap-in position in bung-bushing 10, from which it can be dislodged by tapping with a dispensing fitting and pushed out toward the inside of the container.

The bung-bushing closure is provided with a pressure-compensating valve, whose valve element is bung plug 18.

Bung bushing 10 has a lateral pressure-compensating duct 26 in the form of a radial bore, which passes transversely through bung bushing 10 at about half height. In the driven-in condition of bung bushing 10, the radial bore is disposed above the liquid level in the completely filled container.

The pressure-compensating valve is operated by manually turning bung plug 18 into position in bung bushing 10. The positioning angle is 90E. The closed and pressure-compensating positions of bung plug 18 are marked respectively with "0" and "1" on the bung bushing.

Molded onto its outer surface, bung plug 18 has an outwardly protruding sealing bead 28, which in sealing position is disposed upstream from the inner mouth of pressure-compensating duct 26 and tightly closes pressure-compensating duct 26.

Furthermore, bung plug 18 has on its outer surface an axial groove 30, which in pressure-compensating position maintains the inner mouth of pressure compensating duct 26 in communication with the outside of bung bushing 10 and opens a flow path between the inside of the container and the atmosphere.

In the version according to FIG. 1 to FIG. 4, bung plug 18 has on its outside a slit 32 for engagement of a turning tool, in the form, for example, of a screwdriver, a coin or the like. The closed position and the pressure-compensating position are marked with arrows 34, 36 on bung bushing 10. Bung plug 18 is provided with a corresponding marking arrow 38. Slit 32 is aligned with this marking arrow 38.

In the versions according to FIG. 5 to FIG. 14, an operating element 40 with a handle for tilting upward and turning is embedded in bung plug 18.

Operating element 40 is seated interlockingly in an externally accessible, non-round central opening of bung plug 18. It is snapped together with bung plug 18 by means of an inner annular bead 42 of bung plug 18, which engages in a complementary circumferential groove of operating element 40.

Operating element 40 is seated in bung plug 18 such that it turns therewith. Bung plug 18 has sufficient slippage in bung bushing 20 that, when operating element 40 is turned, the bung plug turns therewith.

Bung bushing 20 has on its outside a recess 44 which widens its central opening and in which a flange 46 attached to operating element 40 rests. This flange is non-round. It has a radially protruding nose 48, which fits into two expansions 50, 52 of bung-bushing recess 44. Thereby the sealing closed position and the pressure-compensating position of bung plug 18 are marked and fixed by snap-in action.

From flange 46 of operating element 40 and extending over half of the circumference thereof there is branched off a bow-shaped handle 54, which can be tilted upward by turning around a diametral spindle 56. Bow-shaped handle 54 is fixed to operating element 40 with ribs 58, which break off and form readily visible fracture surfaces when first tilted upward. Thereby an originality safeguard is created.

Instead of the two ribs 58 shown in the drawing, there can also be provided three or more ribs (not illustrated).

On the bottom of bung-bushing recess 44 there is provided a groove 60, which is disposed in the same diametral plane as pressure-compensating duct 26 and which extends from the central opening of bung bushing 10 to the outside rim of recess 44.

Bung plug 18 functioning as the valve element of the pressure-compensating valve is turned by means of operating element 40, thus moving it from the closed position into the pressure-compensating position and vice versa. Operating element 40 is turned by means of upwardly tilted bow-shaped handle 44. Bung plug 18 turns therewith.

In the pressure-compensating position, a flow path between the inside of the container and the atmosphere is opened via pressure-compensating duct 26 in bung bushing 10, surface groove 30 of bung plug 18 and groove 60 on the bottom of bung-bushing recess 44. In the closed position, the outer mouth of groove 60 is covered and tightly closed by nose 48 on flange 46 of operating element 40.

When the bung-bushing closure is tapped, bung plug 18 occupies its closed position. Operating element 40 is drawn out of the central opening of bung plug 18 by overcoming its catch on bow-shaped handle 54, so that this plug becomes accessible and, by means of a dispensing fitting, can be pushed out from bung bushing 10 toward the inside of the container.

Figure 9:
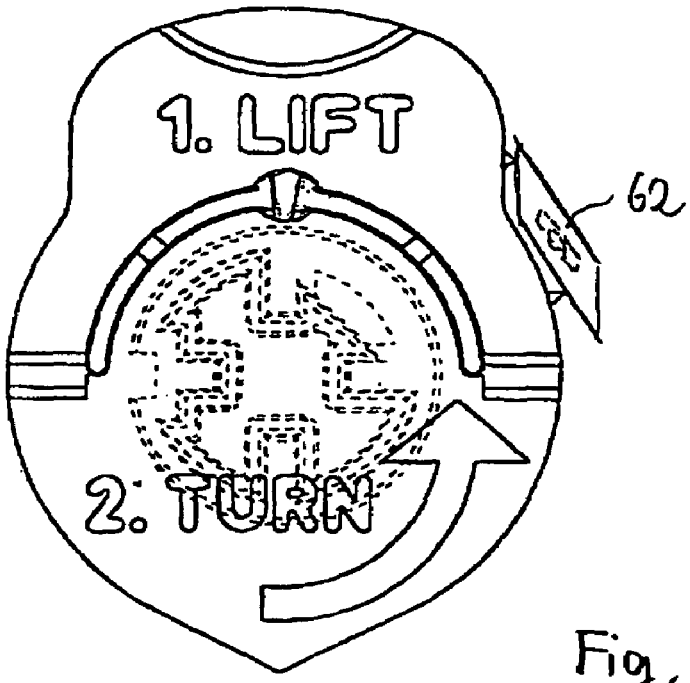
FIG. 9 shows a view from above of the operating element of a three-piece bung-bushing closure in an alternative embodiment.
Figure 10:
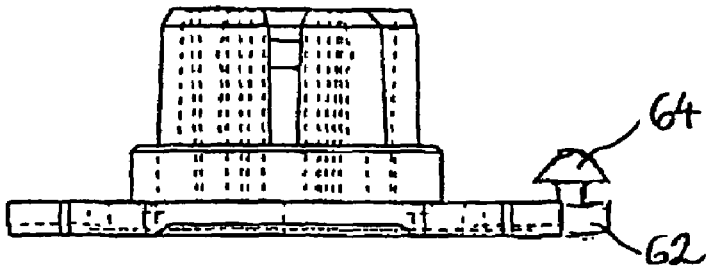
FIG. 10 shows a side view of the operating element.
Figure 11:
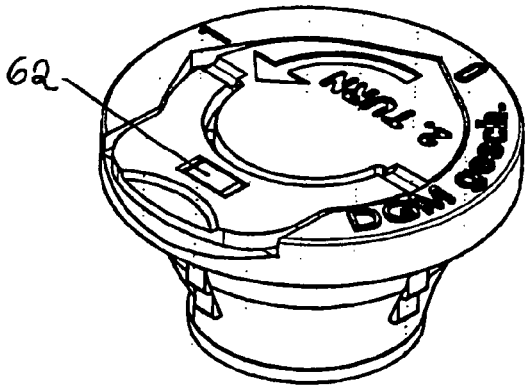
FIG. 11 shows a perspective view of a four-piece bung-bushing closure.
Figure 12:
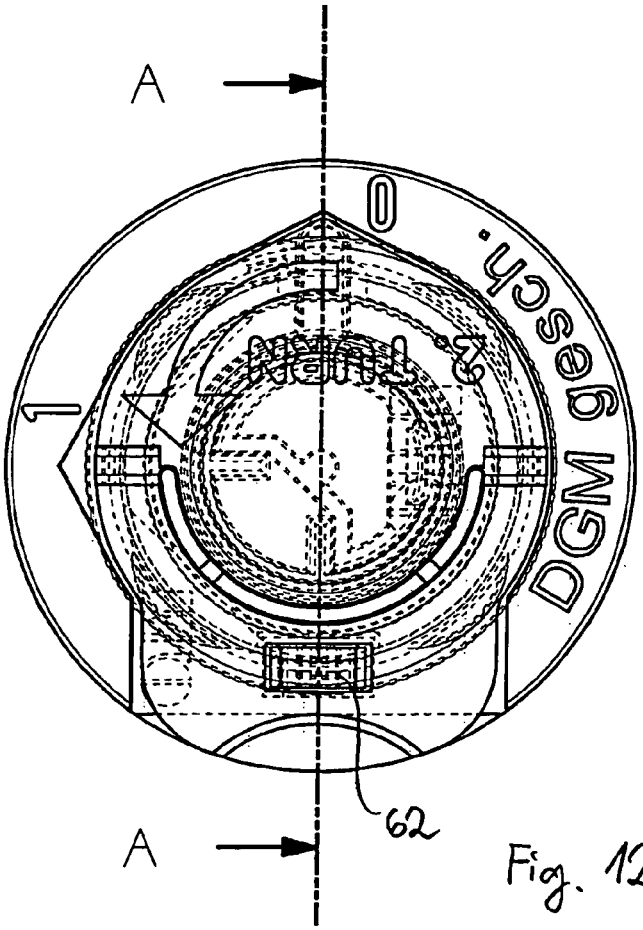
FIG. 12 shows a view from above of a four-piece bung-bushing closure with a section line A-A.
Figure 13:
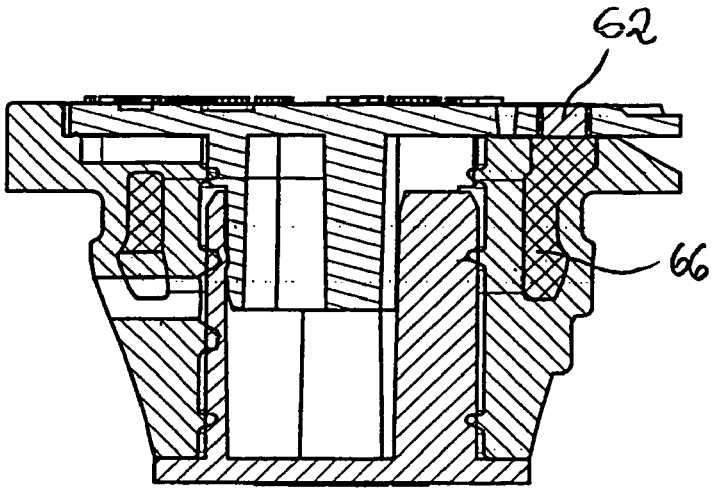
FIG. 13 shows a section through the closure along A-A of FIG. 12.
Figure 14:
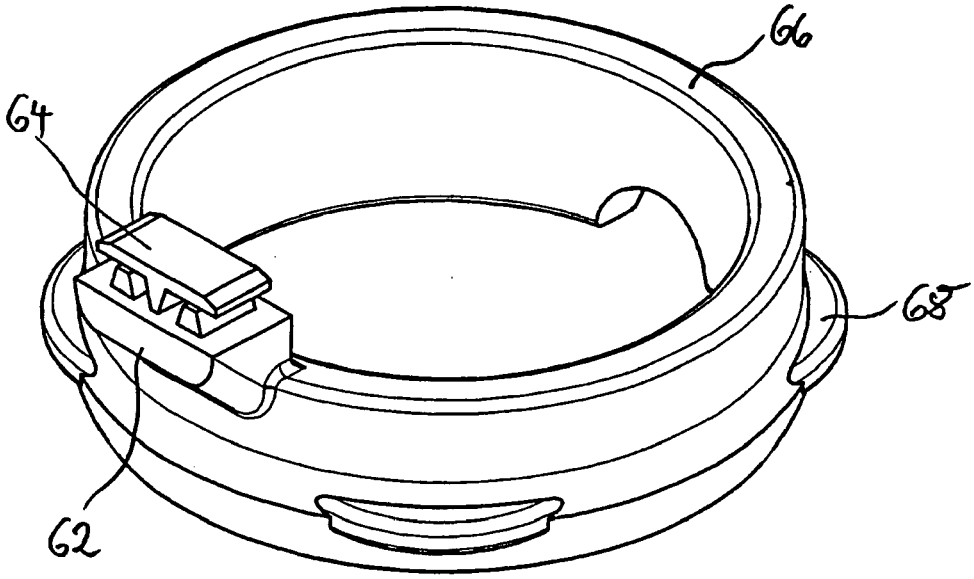
FIG. 14 shows a perspective view of an anchoring ring associated with the four-piece bung-bushing closure.

In the version according to FIG. 9 and FIG. 10, a diamond-shaped lead seal 62 is suspended with thin ribs on bow-shaped handle 54 of operating element 40. Lead seal 62 has on its underside a snap-in pin 64, with which it snaps into a matching opening of bung bushing 10. This is done when operating element 40 is inserted in bung plug 18. When bow-shaped handle 54 is moved for the first time, lead seal 62 tears away.

In the version according to FIG. 11 to FIG. 14, an anchoring ring 66 of hard material is embedded in bung bushing 10. Anchoring ring 66 is injection-molded together with and around bung bushing 10 in the 2-plastic technique. For secure fixation in bung bushing 10, anchoring ring 66 has tongues 68 distributed over the circumference.

A lead seal 62, which projects upward out of bung bushing 10, is suspended with thin ribs on anchoring ring 66. Lead seal 62 has a snap-in pin 64, on which bow-shaped handle 54 of operating element 40 snaps into a matching opening. This is done when operating element 40 is inserted in bung plug 18. When bow-shaped handle 54 is moved for the first time, lead seal 62 tears away from anchoring ring 66.

The invention claimed is:

1. A closure for the charging hole of a liquid container to be filled under pressure, comprising:

a bung bushing of elastic material which fits sealingly into the charging hole, said bung bushing having a central opening, and a bung plug seated sealingly in said central opening and wherein an operating element having a handle is embedded in said bung plug, said bung plug being a valve element of a manually operable pressure-compensating valve and being movable by turning said handle in order to operate the valve, wherein said operating element is removable from said bung plug by pulling it out by means of said handle, and wherein said bung plug can be pushed out towards the inside of the container by means of a dispensing fitting after said operating element has been removed.

2. A closure according to claim 1, wherein said bushing has a lateral pressure-compensating duct having an outer mouth and an inner mouth, said outer mouth being disposed above the liquid level in the completely filled container, and wherein said bung plug has a sealing closed position in which it shuts off said inner mouth of the pressure-compensating duct, and wherein said bung plug has a pressure-compensating position, in which it opens a flow path from the outer mouth of the pressure-compensating duct to said inner mouth thereof and, in turn, to the outside of the bung bushing.

3. A closure according to claim 2, wherein said bung plug has an outwardly protruding sealing bead, which in sealing position is disposed upstream from said inner mouth of said pressure-compensating duct.

4. A closure according to claim 2, wherein said bung plug has a surface groove, which in the pressure-compensating position, maintains said inner mouth of said pressure compensating duct in communication with the outside of the bung bushing.

5. A closure according to claim 4, wherein said surface groove is externally covered and tightly closed in said sealing position.

6. A closure according to claim 1, wherein said bung plug has a non-round central opening and wherein said operating element is seated interlockingly within said non-round opening in said bung plug.

7. A closure according to claim 1, wherein said operating element is mounted in a snap-fit manner in said bung plug.

8. A closure according to claim 1, additionally comprising an originality safeguard, which reveals whether or not the pressure-compensating valve has already been operated.

9. A closure according to claim 1, wherein said handle is fastened to the remainder of the operating element with ribs, which break off when tilted upward for the first time.

10. A closure according to claim 1, wherein said handle comprises a lead seal that snaps into said bung bushing and tears away from said handle when it is moved for the first time.

11. A closure according to claim 1, additionally comprising an anchoring ring, on which a lead seal projecting out of said bung bushing is suspended, embedded in said bung bushing, wherein said handle snaps onto said lead seal, and wherein, when said handle is moved for the first time, said lead seal is torn away from said anchoring ring.

12. A closure according to claim 11, wherein said anchoring ring reinforces said bung bushing, so that it cannot be dislodged from the charging hole of the container without being destroyed.

* * * * *